US005282564A

United States Patent [19]

Vigil Rio

[11] Patent Number: 5,282,564

[45] Date of Patent: Feb. 1, 1994

[54] PUNCH PLASTERER

[76] Inventor: Amaro Vigil Rio, Cervantes No. 2-6° Dcha, Oviedo, Asturias, Spain, 33004

[21] Appl. No.: 945,493

[22] Filed: Sep. 16, 1992

[51] Int. Cl.[5] ..... B25C 1/00

[52] U.S. Cl. ..... 227/14; 227/66; 227/132; 227/134; 227/156

[58] Field of Search ..... 227/14, 66, 48, 130, 227/156, 132, 134

[56] References Cited

U.S. PATENT DOCUMENTS

| | | | |
|---|---|---|---|
| 3,386,639 | 6/1968 | Unger . | |
| 3,581,968 | 6/1971 | Unger | 227/14 |
| 3,595,460 | 7/1971 | Pitkin . | |
| 3,847,321 | 11/1974 | Charlez . | |
| 4,146,339 | 3/1979 | Fleming et al. . | |
| 5,092,508 | 3/1992 | Rio . | |
| 5,143,572 | 9/1992 | Hatch | 227/14 |

FOREIGN PATENT DOCUMENTS

| | | | |
|---|---|---|---|
| 235371 | 9/1960 | Australia | 227/14 |
| 3114337 | 11/1982 | Fed. Rep. of Germany . | |
| 891438 | 12/1981 | U.S.S.R. . | |
| 1238527 | 7/1971 | United Kingdom | 227/14 |

*Primary Examiner*—Scott Smith

*Attorney, Agent, or Firm*—Merchant, Gould, Smith, Edell, Welter & Schmidt

[57] ABSTRACT

A punch plasterer is disclosed which in one action, drives and countersinks a fastener into wood or other materials and which fills the resulting cavity above the fastener thereafter. The present invention includes a punch tool for driving the fastener and first and second resilient springs for reciprocating the punch and for dispensing a predetermined amount of plaster. A plurality of plaster sizes may be used according to the size of the fasteners utilized.

18 Claims, 9 Drawing Sheets

PUNCH PLASTERER

BACKGROUND OF THE INVENTION

1. Field of the Invention

This invention relates generally to carpentry and construction tools, and more specifically, to a tool which in one action, countersinks a fastener and fills the countersink cavity to provide a smooth finish.

2. Description of Related Art

When a carpenter places a nail into a finished piece of wood such as a door or a piece of furniture, it is necessary to countersink the nail and to apply filler to the countersink cavity in order to provide a smooth finish. The filling or plastering process is typically accomplished in two steps. First the nail is countersunk into the material and second, plaster or other filler is manually applied to the cavity created by countersinking. This two step process wastes a considerable amount of time and is not uniform since there is no way of knowing precisely the exact amount of filler needed to fill each cavity. The carpenter inevitably uses too much or not enough plaster. Furthermore, manual plastering becomes very laborious and less precise after repeat applications.

Pneumatically driven nail machines are known which dispense a predetermined quantity of plaster into the cavity thereafter. However, these machines can be expensive, bulky, and not appropriate for all applications. Thus, it can be seen that a device that is relatively small and inexpensive is needed for countersinking nails and for plastering the resulting cavity.

SUMMARY OF THE INVENTION

To overcome the limitations in the prior art described above, and to overcome other limitations that will become apparent upon reading and understanding the present specification, the present invention in accordance with the principles set forth herein, discloses a manually operated punch plasterer. The present invention enables a carpenter to simultaneously embed and countersink a nail and to fill the resulting countersink cavity with the exact amount of filler needed.

A first bias means concentric to the driving axis of the punch is compressed upon striking of an anvil and provides a recuperating force to return the punch to its original position. A second bias means also disposed concentric to the driving axis of the punch, is compressed upon striking the anvil and is not released until the first bias means has substantially returned to its equilibrium state. The second bias means imparts a secondary force to the punch for driving it downwardly to discharge a predetermined portion of filler into the countersink activity.

Thus, in one action of striking the punch anvil, the fastener is countersunk into the material and a predetermined amount of filler is discharged and troweled into the countersink cavity.

These and various other advantages and features of novelty which characterize the invention are pointed out with particularity in the claims annexed hereto and forming a part hereof. However, for a better understanding of the invention, its advantages, and the objects attained by its use, reference should be made to the drawings which form a further part hereof, and to the accompanying descriptive matter, in which there is illustrated and described specific examples of the devices and methods in accordance with the principles of the present invention.

BRIEF DESCRIPTION OF THE DRAWINGS

Referring now to the drawings, which like reference numbers represent corresponding parts throughout.

DETAILED DESCRIPTION OF THE PREFERRED EMBODIMENT

U.S. Pat. No. 5,092,508, entitled "COMPRESSED AIR NAIL MACHINE", issued Mar. 3, 1992, to Vigil Rio, the inventor of the present invention, and which is herein incorporated by reference, discloses a pneumatically operated nail machine incorporating a device which utilizes exhaust for filling the cavity above each nail head after it is placed into the wood.

In the following description of the preferred embodiment, a manually operated punch plasterer which utilizes first and second bias means is disclosed. Reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Throughout the specification, reference in which the device is to be practiced is made to a nail as the fastener and wax as the filler. Those skilled in the art will be able to bring to mind other suitable expedients for fasteners and plasters for which the principles of the present invention may be practiced.

Figure 1:
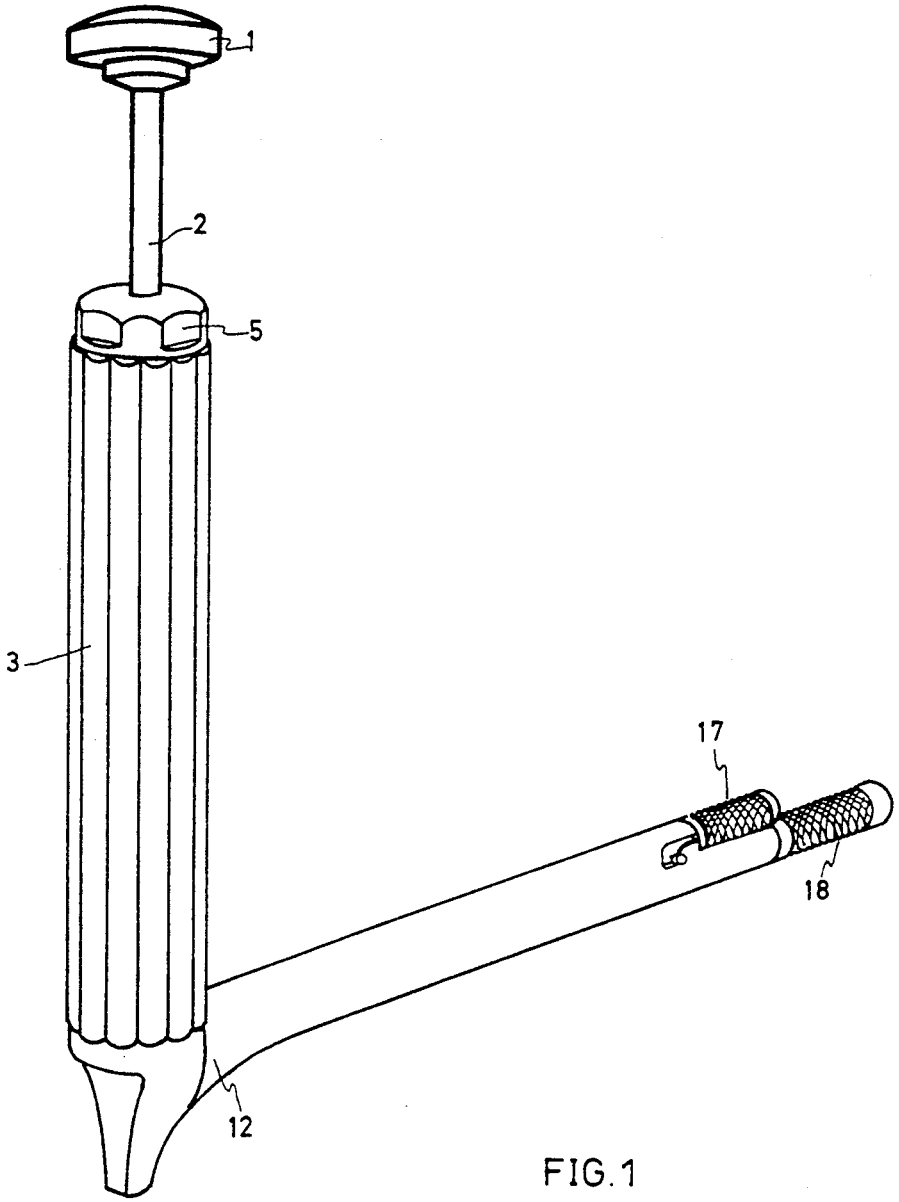
FIG. 1 is a perspective view of a punch plaster in accordance with the principals of the present invention.
Figure 3:
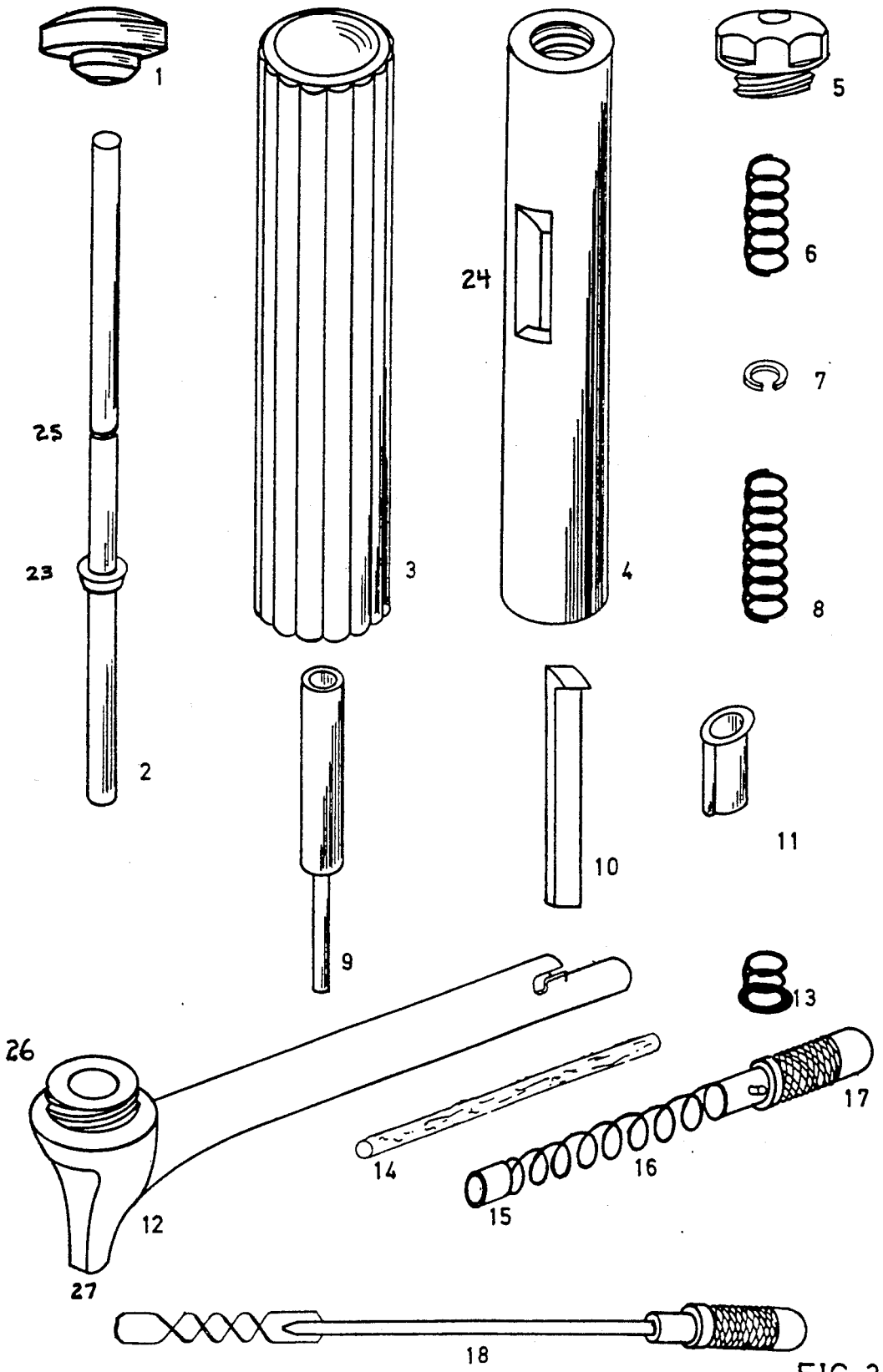
FIG. 3 is an exploded view of the punch plasterer in accordance with the principles of the present invention.

Reference is now made to FIGS. 1 and 3 which depict a perspective view and an exploded view of the punch plasterer in accordance with the principles of the present invention.

An anvil 1 manufactured of a steel or a plastic material suitable to withstand substantial striking forces, is disposed at a proximal end of the device. A substantially cylindrical rod 2 is attached to the anvil 1 and extends from the proximal end towards a distal end. The rod 2 is manufactured of a high-quality steel suitable for withstanding sizable striking forces.

Forming the body of the present invention, is a cylinder 4 substantially concentric with the rod 2. The cylinder 4 is threaded in both its proximal and distal end and maybe made of a rough cast steel. The cylinder 4 comprises a first chamber in its proximal end having interior walls defining an aperture concentric with the rod 2 but of a slightly larger diameter. The cylinder 4 further comprises a second chamber in its distal end having interior walls of a diameter larger than the first chamber and including two notched grooves 24 for operative engagement with a pair of hook members 10, described in more detail herein below.

Forming the exterior portion of the body is a knurled elastomer or rubber grip 3 disposed on the outer surface of the cylinder 4 for providing an easy grip surface.

An end cap 5 having a substantially annular concentric aperture is threaded into the cylinder 4 at the proximal end. The rod 2 passes through the aperture in the end cap 5 and is rigidly attached at the proximal side to the anvil 1 and the distal end of the rod 2 extends through the first and second chambers of cylinder 4. A ferrule 23 is annularly disposed around rod 2 at a distance approximately one-half to two-thirds from its proximal to its distal end. Rod 2 has a groove 25 machined around its circumference at a distance approximately one-third to one-half from its proximal end to its distal end for receiving a retaining ring 7.

A first bias means 6, such as, but not limited to, a spring, of predetermined stiffness having a diameter slightly larger than the aperture defined by the first chamber in cylinder 4, is disposed coaxial and coextensive with the rod 2 between the retaining ring 7 and the inner wall of the first chamber. Retaining ring 7 inhibits the first bias means 6 and the rod 2 from traveling through the aperture in end cap 5. Forces applied to the anvil 1 compress first bias means 6. The compression of first bias means 6 stores recuperating energy to return rod 2 to its original position.

A second bias means 8, such as, but not limited to, a spring, having a stiffness greater than the first bias means 6 is disposed coaxial and coextensive along the distal end of rod 2 between the ferrule 23 and a punch tool 9. The punch tool 9 is made of a similar high-quality steel as the rod 2 and has a substantially cylindrical body with an orifice at its proximal end for operative engagement with rod 2. The thrust of the rod 2 imparts a force on the punch tool 9 as the rod 2 is stroked in a direction towards the distal end. At its distal end, the punch tool 9 has a substantially cylindrical member of lesser diameter than its body for imparting the applied force onto the head of the fastener 21. A pair of flexible hook members 10 are attached to the side walls of the body of the punch tool 9 and extend substantially parallel to the rod 2 towards the proximal end. The flexible hook members 10 operably engage the ferrule 23 on the rod 2 during a down stroke of the rod 2 in response to a force being imparted on the anvil 1. On an up stroke of the rod 2, the hook members 10 are disengaged from the ferrule 23 as they contact the notched grooves 24 in the interior walls of the second chamber in cylinder 4.

Figure 2:
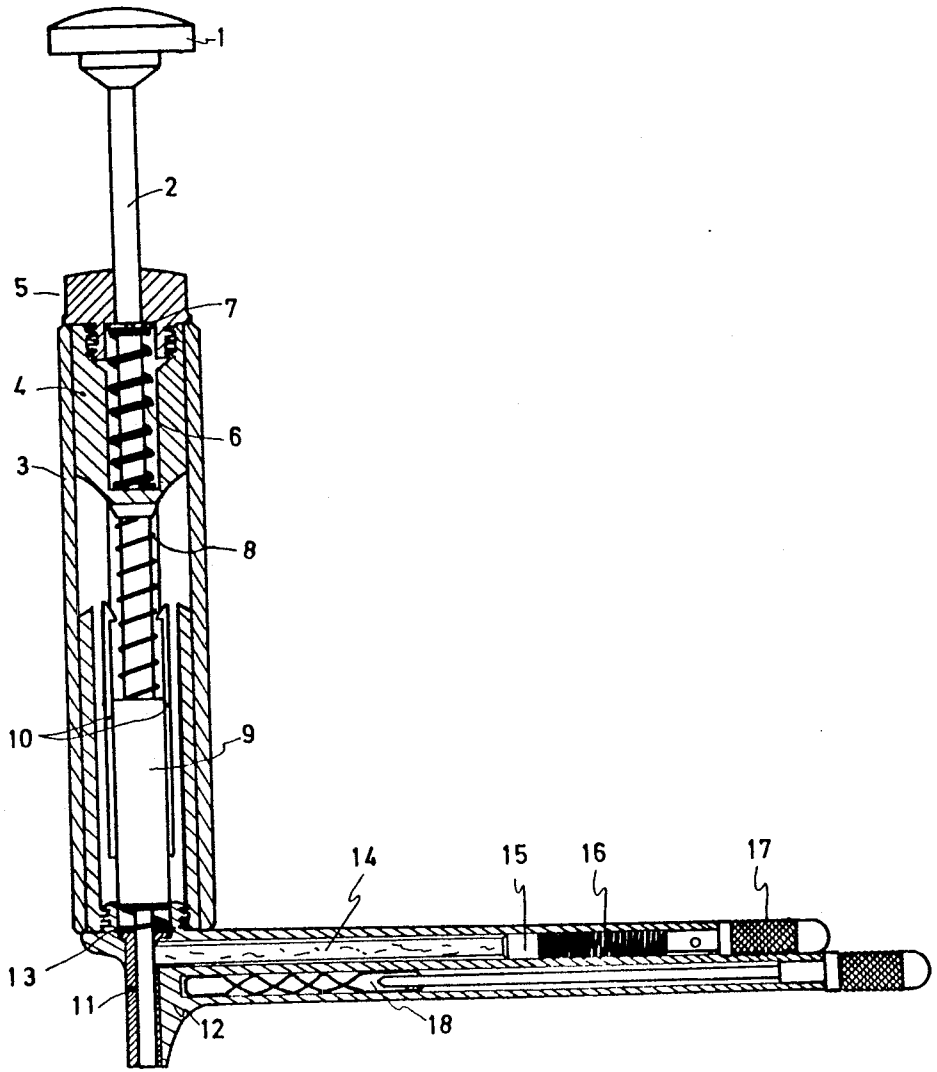
FIG. 2 is a cross sectional side view of the punch plasterer in an inoperative position.

As best seen in FIGS. 2 and 3, a body 12 made of steel or plastic, has mating threads 26 for coupling to the distal end of cylinder 4. The body 12 includes a contoured mouth 27 defining an aperture having an axis which is substantially concentric with the axis of the rod 2. The punch tool 9 has a mating guide 11 disposed within the mouth 27. The internal diameter of the guide 11 is substantially equal to the external diameter of the punch tool 9. The exterior of the guide 11 has salient features to prevent movement within the mouth 27. The guide 11 has an orifice in its side wall in operative alignment with the portion of the body 12 which stores the wax 14.

The punch tool 9 and guide 11 are interchangeable as a pair for different applications. The mating thread 26 of the body 12 is unscrewed to remove the body 12 from the cylinder 4, thereby releasing the punch tool 9 and guide 11 from the cylinder 4. A replacement punch tool 9 and guide 11, having more or less width, may be used in place of the first punch tool 9 and guide 11.

The body 12 extends substantially perpendicular to the axis of the rod 2. The body 12 defines a hollow cylinder for housing a filler bar such as wax, and an assembly that provides means for advancing the filler into the contoured mouth 27. The means for advancing the filler comprises a plastic thrust piece 15 for engagement with a filler bar 14, a thrust bias means 16 coupled to the thrust piece 15 for providing compressive forces for advancing the filler into the contoured mouth 27, and a coupling 17 for securing the assembly to the proximal end of the body 12. The coupling 17 may include a bayonet member for securing the assembly to the body 12 and for providing easy release. Those skilled in the art will be able to bring to mind other suitable expedients for a quick release coupling for which the principles of the present invention may be practiced. The body 12 may include an additional area for providing storage for a helical shaped cleaner 18. The cleaner 18 is preferably made of metal or plastic. In the preferred embodiment, the storage area is a hollow cylindrical region in the body 12 parallel and beneath the means for advancing the filler. The cleaner 18 is removable disposed in the cylindrical region and maybe used to clean filler from the body 12.

Figure 9:
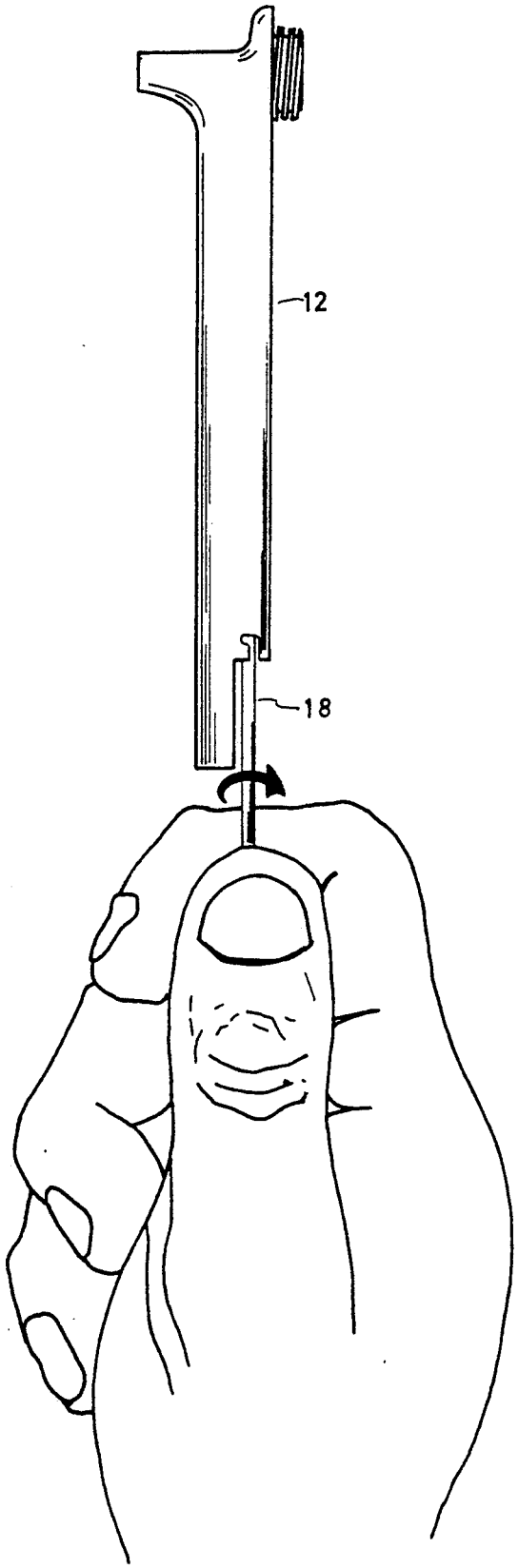
FIG. 9 is a view of how the punch plasterer is cleaned.

Referring now to FIG. 9, the cleaner 18 is depicted for cleaning filler from the body 12. The body 12 is removed from the cylinder 4 to avoid contact between the cleaner 18 and the punch tool 9. Although this feature is optional, it is useful for removing filler from the body 12 in the event that the body 12 was exposed to excessive heat such as being left in the sun.

A third bias means 13 having a body which flares from its proximal end to its distal end is operatively disposed between the punch tool 9 and the body 12 for providing dampening. The third bias means 13 has little stiffness and has an approximately displacement of two millimeters. To protect the surface of the material in which the fastener 21 is being driven, the third bias means 13 provides dampening so the forces applied to the anvil 1 are substantially transmitted through the punch tool 9 to the fastener 21 and not through the rest of the device. All of the applied energy to the anvil 1 passes to the fastener 21 not to the wood.

Reference is now made to FIGS. 4, 5, 6, and 7 which depict the present invention in four stages of operation.

Figure 4:
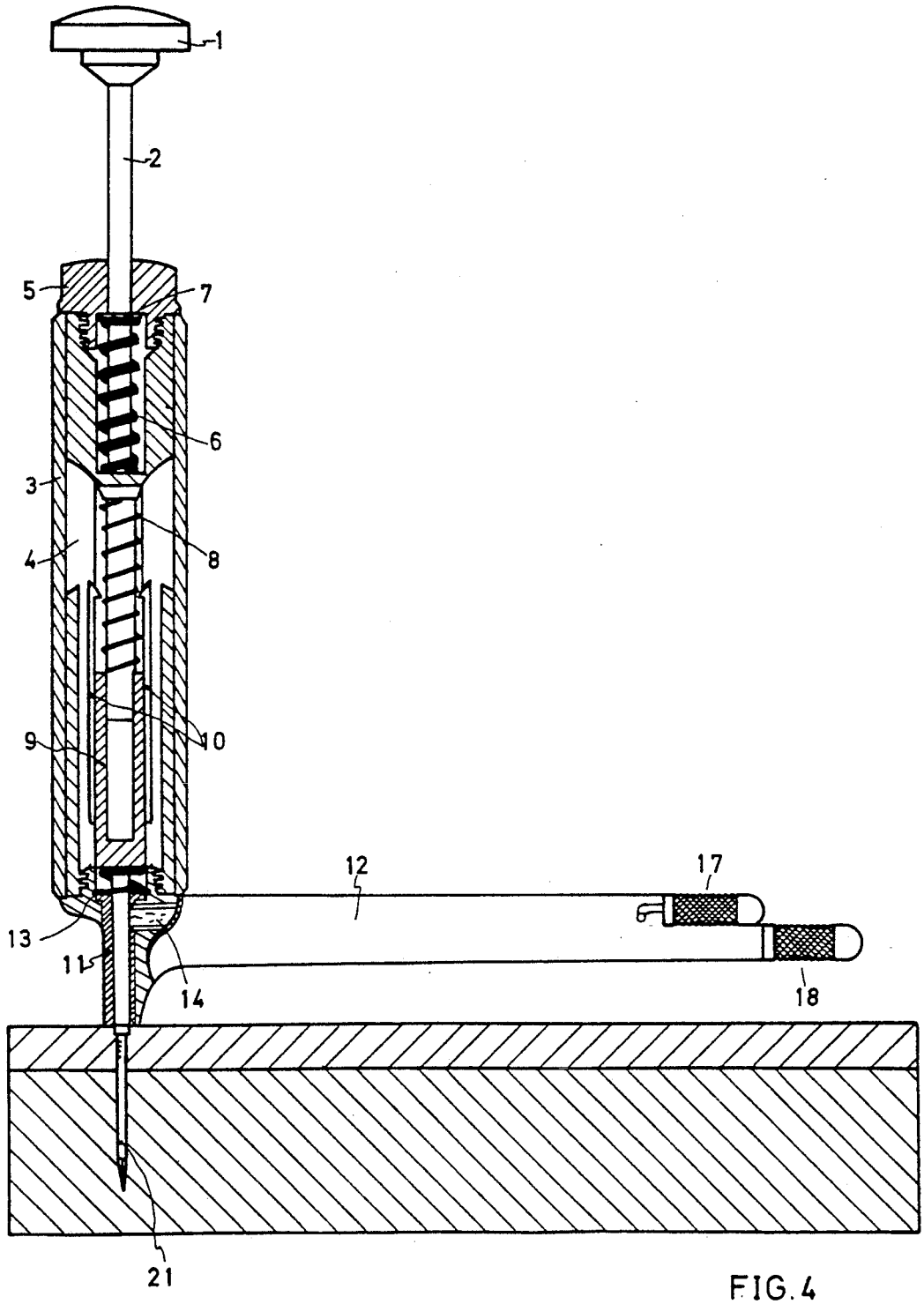
FIG. 4 is a cut away view of the punch plasterer in accordance with the principles of the present invention.

In FIG. 4, the plaster punch is placed over the fastener 21 after it is driven into the wood. First bias means 6 and second bias means 8 are in an equilibrium state.

Figure 5:
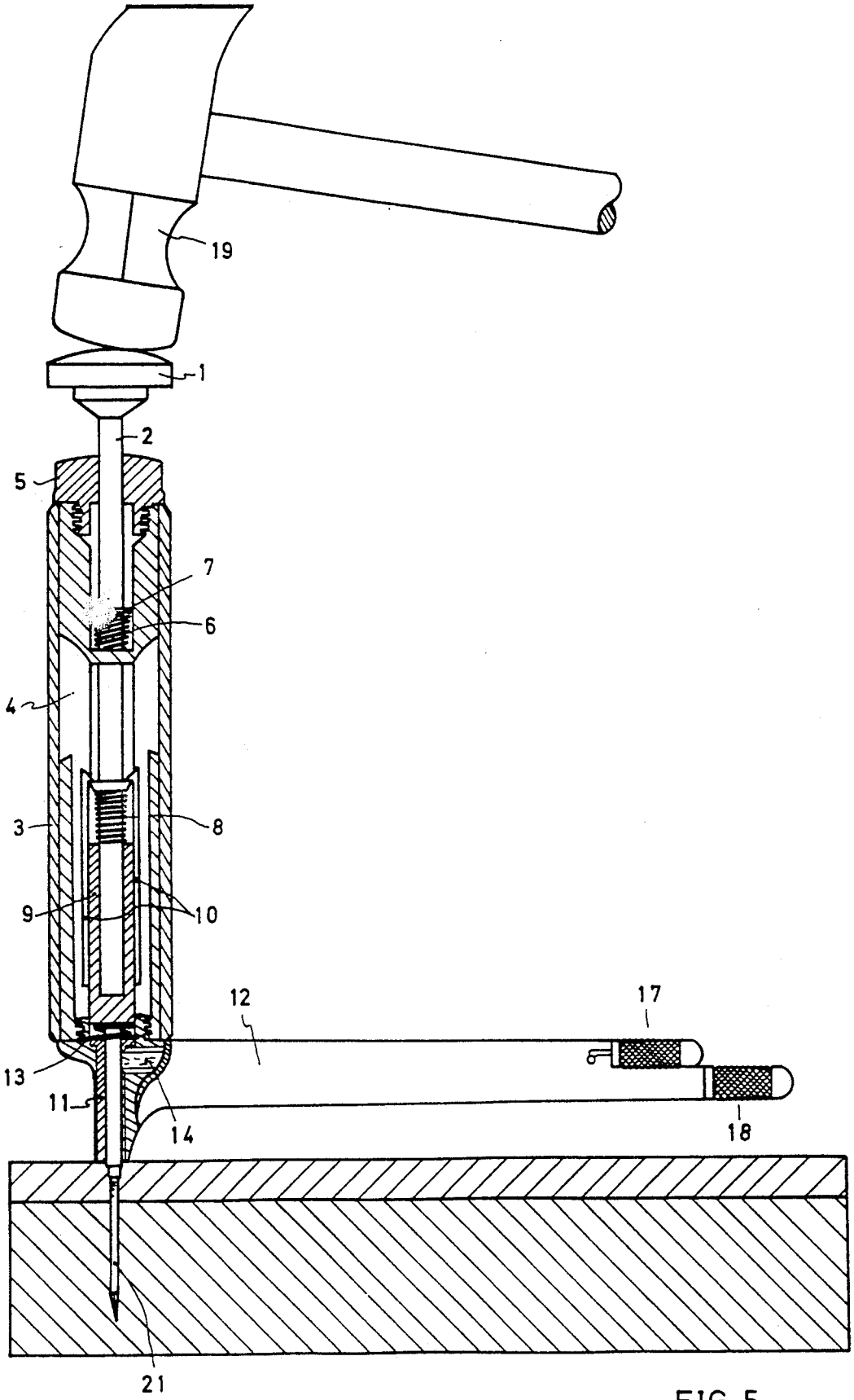
FIG. 5 is a view of the punch plasterer in a first operative position.

In FIG. 5, a hammer 19 applies a force to anvil 1 which is transmitted through the rod 2, to the punch tool 9, and to the fastener 21. Displacement of the rod 2 forces the external retaining ring 7 to compress the first bias means 6 between the retaining ring 7 and the wall defining the aperture between the first and second chambers in cylinder 4. The displacement of rod 2 also compresses the second bias means 8 between the ferrule 23 and the punch tool 9. As best seen in FIG. 5, the completion of the downstroke of rod 2 engages hook members 10 onto ferrule 23.

Figure 6:
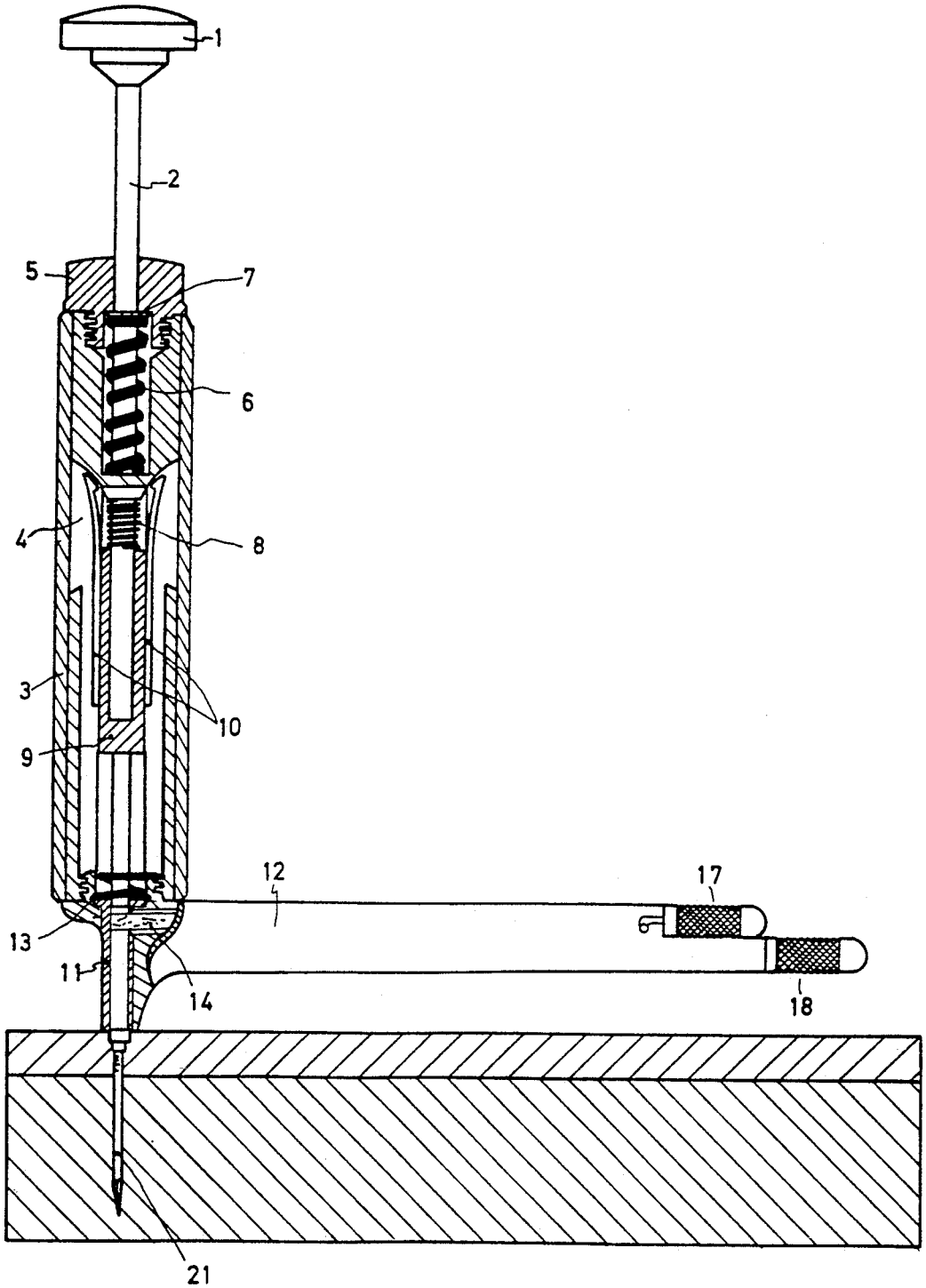
FIG. 6 is a view of the punch plasterer in a second intermediate operative position.

As best seen in FIG. 6, first bias means 6 recuperates rod 2 to its original position pulling up the punch tool 9. The recuperation of the punch tool 9 draws a predetermined amount of filler 14 into the guide 11 disposed in mouth 27. The recuperation of the punch tool 9 also brings hook members 10 into operative engagement with notched grooves 24 in the interior walls of the second chamber of cylinder 4.

Figure 7:
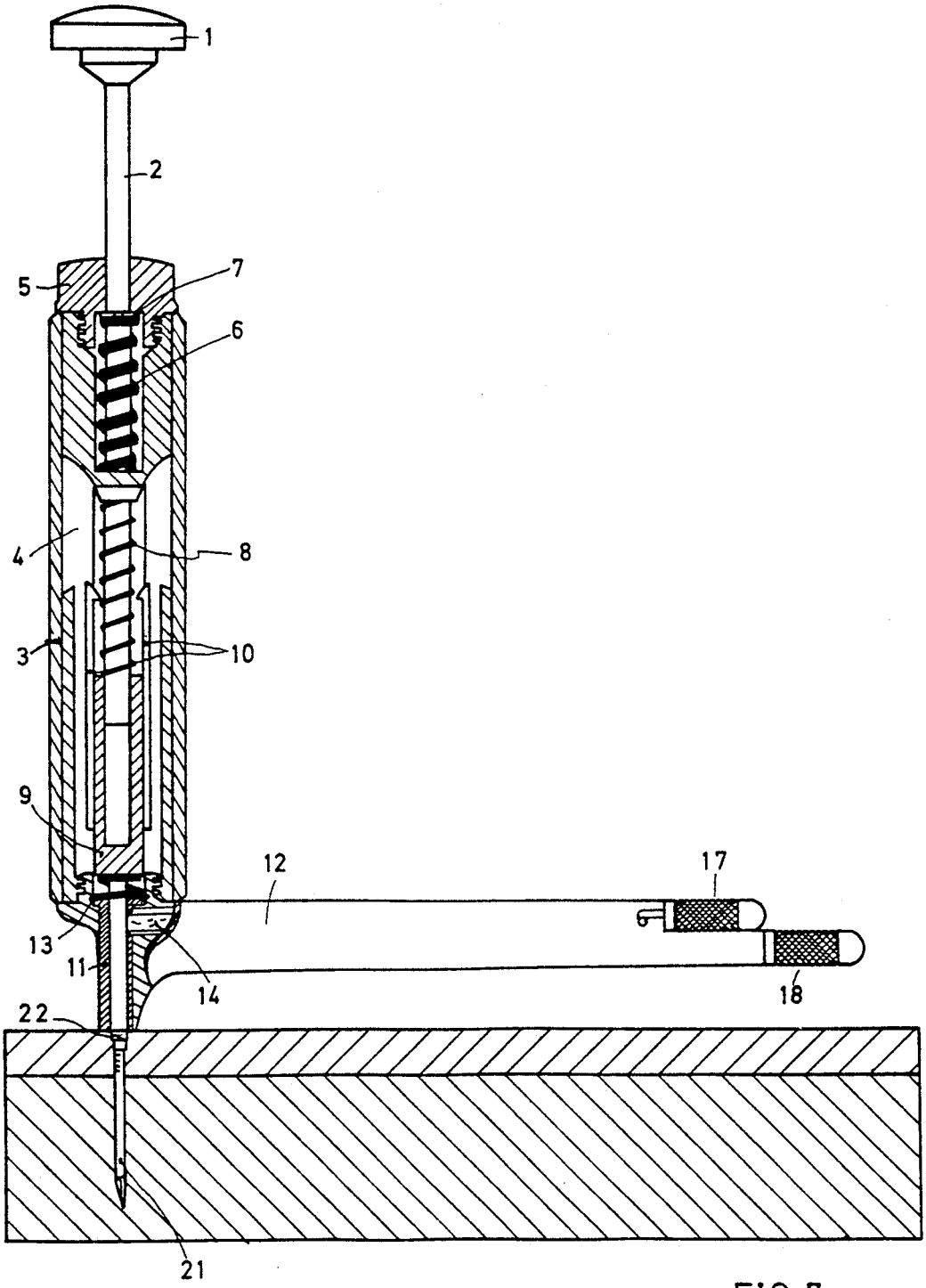
FIG. 7 is a view of the punch plasterer in a third operative position.

As best seen in FIG. 7, the engagement with notched grooves 24 causes hook members 10 to flex and disengage from the ferrule 23. Disengagement of the hook members releases the second bias means 8 to drive the punch tool 9 downwardly. The punch tool forces the predetermined amount of filler 14 in guide 11 into the cavity 22 above the fastener 21. The second bias means 8 has a sufficient stiffness to compress the filler 14 into the cavity 22 providing a smooth finish on the wood.

Figure 8:
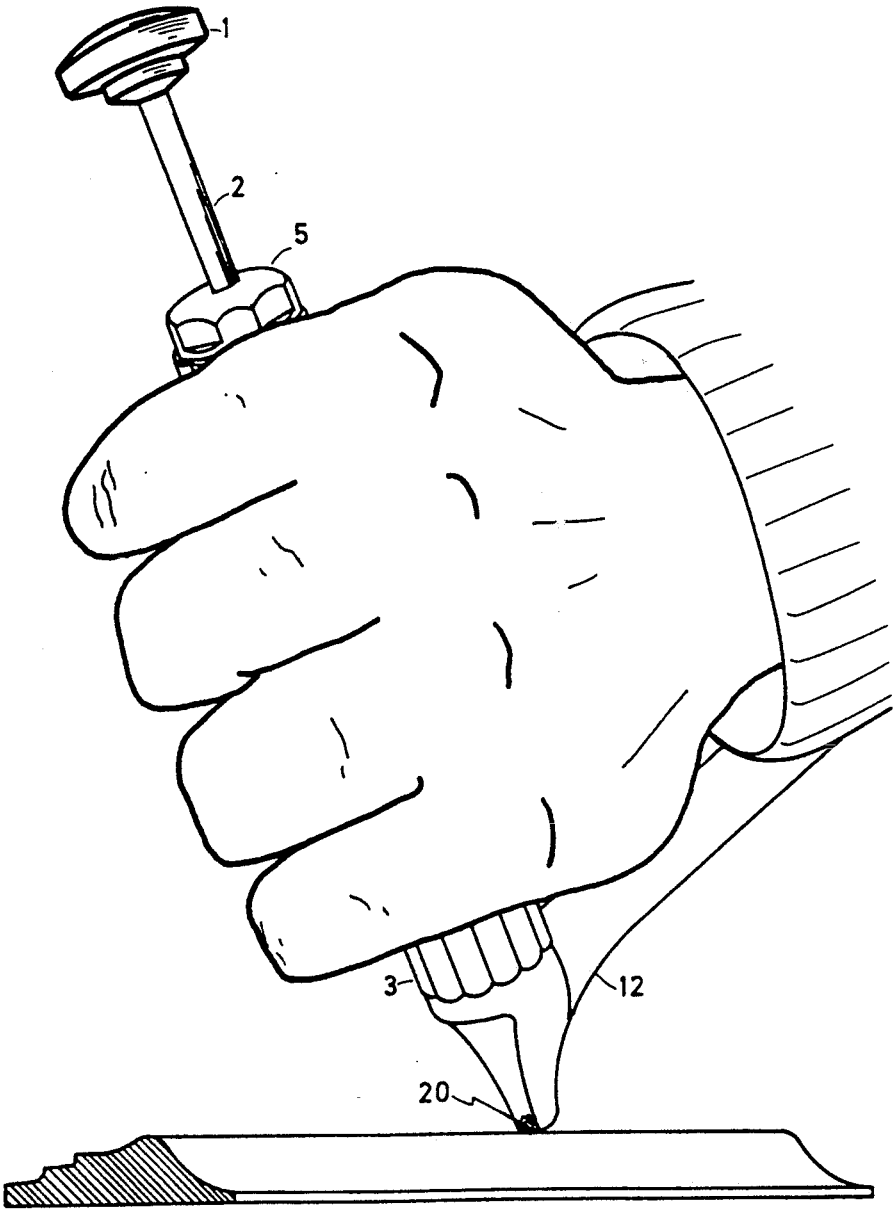
FIG. 8 is a view of the punch plasterer taking away surplus wax.

Referring now to FIG. 8, the mouth 27 of the body 12 may include a beveled edge 20 for removing excess filler in the event that the fastener 21 was driven into an uneven surface such as a molding. The punch plaster is slightly inclined and scraped in a forward direction much like a carpenter's plane or pallet knife would be used. Excess filler will remain fastened on the beveled edge 20.

The foregoing description of the preferred embodiment of the invention has been presented for the purposes of illustration and description. It is not intended to be exhaustive or to limit the invention to the precise form disclosed. Any modifications or variations are possible in light of the above teaching. It is intended that the scope of the invention be limited not by this detailed description, but rather by the claims amended hereto.

What is claimed is:

1. A punch plasterer for driving a fastener into a material and filling a resulting cavity with filler in response to an applied striking force, comprising:
   (a) anvil means for receiving a striking force;
   (b) a rod, disposed through a body and coupled to the anvil means, for transmitting the striking force, wherein the body defines a chamber;
   (c) punch means, coupled to the rod and disposed within the chamber of the body, for transferring the striking force from the rod to a fastener, thereby driving the fastener into the material to create a cavity;
   (d) first and second bias means, disposed within the chamber, wherein the first bias means returns the rod to its original position after the rod has been displaced in transmitting the striking force, and the second bias means imparts a secondary force on the punch means after the rod returns to its original position, thereby discharging a predetermined portion of filler into the cavity;
   (e) filler storage means, coupled to the body, for storing the filler; and
   (f) dispenser means, disposed within the filler storage means, for advancing a predetermined amount of the filler into the chamber for engagement by the punch means.

2. A punch plasterer as recited in claim 1 wherein the anvil means is of steel manufacture and can withstand substantial striking forces.

3. A punch plasterer as recited in claim 1 wherein the anvil means is of plastic manufacture and can withstand substantial striking forces.

4. A punch plasterer as recited in claim 1 wherein the punch means is interchangeable and selectable according to the fastener size.

5. A punch plasterer as recited in claim 1 wherein the filler storage means further comprises an area for providing storage for a detachable cleaner for cleaning excess filler within the punch plasterer.

6. A punch plasterer as recited in claim 1 wherein the body further includes a beveled edge for removing excess filler from an applied surface.

7. A punch plasterer for embedding and countersinking a fastener into a material and filling the resulting cavity with plaster, the punch plasterer comprising:
   (a) an anvil suitable for withstanding substantial striking forces;
   (b) a rod having a proximal end attached to the anvil and extending from the proximal end towards a distal end;
   (c) a substantially cylindrical body spanning the length of the rod and including plaster storage means for storing plaster and means for advancing a predetermined amount of plaster from the plaster storage means into the body
   (d) punch means, disposed within the substantially cylindrical body and coupled to the rod at the distal end, for driving a fastener in a material;
   (e) first bias means of predetermined stiffness, disposed within the substantially cylindrical body and coupled to the rod, for returning the rod to its original position after a force is applied to the anvil; and
   (f) second bias means, having a stiffness greater than the first bias means and disposed within the substantially cylindrical body and coupled to the rod, for driving the punch means for discharge a predetermined portion of plaster from the body into the cavity after the first bias means returns the rod to its original position.

8. A punch plasterer as recited in claim 7 further comprising hook members operably engageable to the rod during a down stroke of the rod in response to a force being imparted on the anvil, wherein at a completion of an up stroke of the rod, the hook members disengaged to release the second bias means.

9. A punch plasterer as recited in claim 7 further comprising a knurled elastomer grip disposed on an outer surface of the cylinder body for providing an easy grip surface.

10. A punch plasterer as recited in claim 7 wherein the punch means is interchangeable and selectable according to the fastener size.

11. A punch plasterer as recited in claim 7 wherein the plaster is interchangeable and selectable.

12. A punch plasterer as recited in claim 7 further comprising an area for providing storage for a detachable helical shaped cleaner for cleaning excess plaster within the punch plasterer.

13. A punch plasterer as recited in claim 7 wherein the body further includes a beveled edge for removing excess plaster from an applied surface.

14. A punch plasterer as recited in claim 7 wherein the body further comprises a first chamber in its proximal end having interior walls defining an aperture concentric with the rod but of a slightly larger diameter and a second chamber in its distal end having interior walls of a diameter larger than the first chamber and including at least one notched groove for operative engagement with at least one hook member.

15. A punch plasterer as recited in claim 7 wherein the means for advancing a predetermined amount of plaster further comprises:
   (i) a plastic thrust piece for engagement with a filler bar;

(ii) a thrust bias means coupled to the thrust piece for providing compressive forces for advancing the filler bar; and (iii) a coupling for securing the thrust piece to the body.

16. A punch plasterer for driving a fastener into a material using a striking force applied by a hammer and filling a resulting cavity with filler, comprising:

(a) anvil means for receiving said striking force from said hammer;

(b) a body, coupled to said anvil, having a first chamber and a second chamber, and said body having filler storage means for storing said filler and having dispensing means for advancing a predetermined amount of said filler into the second chamber;

(c) rod means for transmitting said striking force received by said anvil means, having an original position, a proximal end and a distal end, said proximal end attached to said anvil means and extending from said proximal end toward said distal end, and said rod disposed within said first chamber and second chamber of said body;

(d) punch means, coupled to said rod at said distal end and disposed within said second chamber of said body, for transferring said striking force from said rod means to said fastener, wherein said fastener is driven into said material, thereby creating a cavity;

(e) first bias means, disposed within said first chamber of said body and coupled to said rod, for returning said rod to said original position after said striking force is received by said rod means, and further, said first bias means having a predetermined stiffness; and (f) second bias means disposed within said second chamber of said body and coupled to said rod means, for imparting a force on said punch means to dispense a predetermined portion of said filler into said cavity after said first bias means returns said rod means to said original position, and further, said second bias means having a stiffness greater than said first bias means.

17. A punch plasterer as recited in claim 16 wherein the first chamber of the body has interior walls at a proximal end thereof defining an aperture concentric with the rod but of a slightly larger diameter, the second chamber in a distal end having interior walls of a diameter larger than the first chamber and including at least one notched groove for operative engagement with at least one hook member.

18. A punch plasterer as recited in claim 16 wherein the means for advancing a predetermined amount of plaster further comprises:

(i) a plastic thrust piece for engagement with a filer bar;

(ii) a thrust bias means coupled to the thrust piece for providing compressive forces for advancing the filler bar; and (iii) a coupling for securing the plastic thrust piece to the body.

* * * * *

UNITED STATES PATENT AND TRADEMARK OFFICE

CERTIFICATE OF CORRECTION

PATENT NO. : 5,282,564

DATED : February 1, 1994

INVENTOR(S) : Amaro Vigil Rio

It is certified that error appears in the above-identified patent and that said Letters Patent is hereby corrected as shown below:

Col. 6, Line 18: Insert --;-- after the word "body"

Col. 8, Line 24: "filer" should read --filler--

Signed and Sealed this

Eleventh Day of October, 1994

*Attest:*

Bruce Lehman

BRUCE LEHMAN

*Attesting Officer*

*Commissioner of Patents and Trademarks*